US006291051B1

(12) United States Patent
Shimizu

(10) Patent No.: US 6,291,051 B1
(45) Date of Patent: Sep. 18, 2001

(54) WATERPROOF SHEET FOR HAIR WASHING AND AUTOMATIC HAIR WASHER USING SUCH WATERPROOF SHEET

(75) Inventor: Hirohisa Shimizu, Osaka (JP)

(73) Assignee: Oohiro Works, Ltd., Osaka (JP)

( * ) Notice: Subject to any disclaimer, the term of this patent is extended or adjusted under 35 U.S.C. 154(b) by 0 days.

(21) Appl. No.: 09/412,464

(22) Filed: Oct. 5, 1999

(30) Foreign Application Priority Data

Feb. 1, 1999 (JP) ..... 11-024049

(51) Int. Cl.[7] ..... B32B 3/10; A45D 19/00; A45D 44/12

(52) U.S. Cl. ..... 428/131; 4/517; 4/520

(58) Field of Search ..... 428/101, 131, 428/223; 404/515, 516, 517, 518, 519, 520, 521, 522, 523

(56) References Cited

U.S. PATENT DOCUMENTS 3,854,148 * 12/1974 La Rose .
5,022,102 * 6/1991 Louvaris .
5,099,865 * 3/1992 Flannery et al. .
5,146,629 * 9/1992 Barnes .
5,289,597 * 3/1994 Sidola .
5,337,423 * 8/1994 Young .
5,906,012 * 5/1999 Sakane et al. .
5,940,885 * 8/1999 Matthews .
5,946,745 * 9/1999 Magee .
5,953,768 * 9/1999 Jarosz et al. .

FOREIGN PATENT DOCUMENTS 6-217820 8/1994 (JP) .
7-08317 1/1995 (JP) .
7-177924 7/1995 (JP) .
7-184715 7/1995 (JP) .
02000217625-A* 8/2000 (JP) .

* cited by examiner

*Primary Examiner*—Tom Dunn
*Assistant Examiner*—Kiley Stoner
(74) *Attorney, Agent, or Firm*—Burr & Brown

(57) ABSTRACT

The present invention prevents the leakage of wash water by securely eliminating a gap between an opening of a face cover and a face of a person under hair washing regardless of the size of the face of the person, when hair washing is performed using an automatic hair washer. A hair washing waterproof sheet comprises an approximately rectangular vinyl sheet having an opening 1*a* of such a size that a head can be inserted though, in the center. The waterproof sheet has an outer circumference part 1*c* and an inner circumference part 1*b* which are passed through by elastic braids, thereby being stretchable. Further, magic tapes 2 for fixing the inner circumference part 1*b* to the person under hair washing are provided at opposed positions of a lower part of the inner circumference part 1*b*.

2 Claims, 5 Drawing Sheets

Fig.5 - PRIOR ART
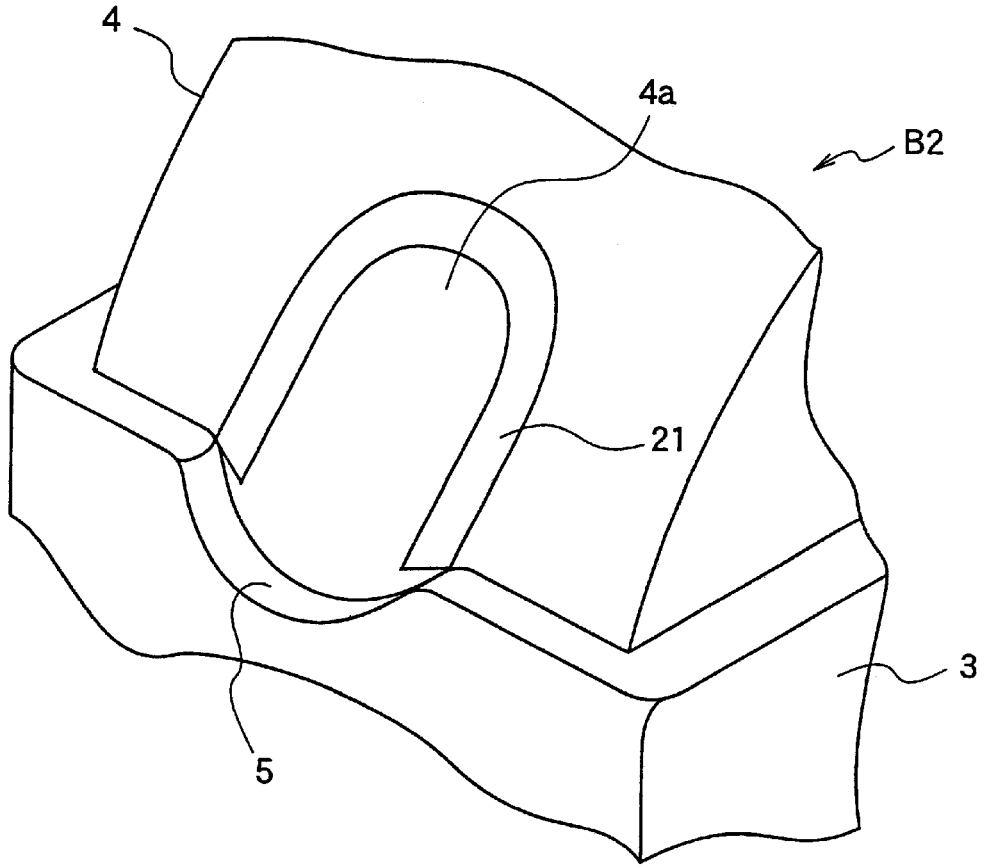

WATERPROOF SHEET FOR HAIR WASHING AND AUTOMATIC HAIR WASHER USING SUCH WATERPROOF SHEET

FIELD OF THE INVENTION

The present invention relates to a waterproof sheet for hair washing which prevents wash water from leaking through a gap between a face cover of an automatic hair washer and a face part of a person under hair washing, while hair is washed, and an automatic hair washer using such a waterproof sheet.

BACKGROUND OF THE INVENTION

FIG. 5 is a perspective view schematically illustrating a structure of a face cover part of a prior art automatic hair washer.

Reference character B2 designates an automatic hair washer. Numeral 3 designates a cistern and numeral 4 designates a face cover openably/closably attached to the cistern 3 so as to cover the cistern 3. The face cover 4 has an opening 4*a* for putting out the face of a person under hair washing, lying on his back and inserting his head toward the cistern 3. A face seal 21 having flexibility of materials such as rubber is attached along the opening 4*a*.

When the head of the person under hair washing is directed to the cistern 3 and then the face cover 4 is closed, the face seal 21 along the opening 4*a* of the face cover 4 is adhered to the face part of the person under hair washing, thereby, while the hair is washed, preventing the wash water from leaking through a gap between an edge part of the opening 4*a* and the face of the person and splashing on the face of the person.

However, in the prior art automatic hair washer, since the sizes of the faces vary with persons under hair washing, pressures applied by the face seal to the faces vary with persons, whereby some persons feel something is wrong on the face. Or, when the face of the person under hair washing is quite small, for example, when the person under hair washing is a child, the face seal is not adhered to the face when the face cover is closed. Therefore, a gap is produced between the face part of the person and the face seal, whereby the wash water leaks through the gap.

SUMMARY OF THE INVENTION

The present invention is made to solve the above-mentioned problem and has an object to provide a waterproof sheet for hair washing which can fit to the face of a user according to the size of the face of the user without making the user feel that something is wrong and can prevent the leakage of water, and to provide an automatic hair washer using such a waterproof sheet.

Other objects and advantages of the present invention will become apparent from the detailed description and specific embodiments described are provided only for illustration since various additions and modifications within the spirit and scope of the invention will be apparent to those of skill in the art from the detailed description.

According to a first aspect of the present invention, there is provided a hair washing waterproof sheet used when hair washing is performed with an automatic hair washer, which comprises a cistern capable of accommodating a head part of a person under hair washing, and a face cover which is openably/closably attached to the cistern and has an opening for directing only a face outside, the hair washing waterproof sheet preventing wash water from leaking through a gap between the opening of the face cover and the head part of the person, comprising: an approximately rectangular sheet having an opening in the center; an outer circumference part attached to the automatic hair washer and an inner circumference part in contact with the head part of the person under hair washing, the outer and inner circumference parts being made crinkled by elastically stretchable strings; and coupling means for fixing the inner circumference part to the person under hair washing, the coupling means being provided at opposed positions of a lower part of the inner circumference part. Therefore, when the head is inserted through the opening toward the cistern, the hair washing waterproof sheet can be adjusted according to the size of the face of the person under hair washing so that a gap is not formed between the opening of the face cover and the face part of the person under hair washing, thereby preventing the leakage of the wash water without making the person under hair washing feel something is wrong at the face.

Further, the leakage of water can be prevented more economically with relative to the face cover which is used in the prior art automatic hair washer.

According to a second aspect of the present invention, there is provided an automatic hair washer using the hair washing waterproof sheet according to the first aspect, comprising: a hook for fastening the outer circumference part of the hair washing waterproof sheet, the hook being provided at an edge part of the opening of the face cover. Therefore, it is easy to attach/detach the hair washing waterproof sheet to/from the face cover.

BRIEF DESCRIPTION OF THE DRAWINGS

FIG. 5 is a perspective view schematically illustrating a structure of a face cover part of a prior art automatic hair washer.

DETAILED DESCRIPTION OF THE PREFERRED EMBODIMENTS

Embodiment 1

Figure 1:
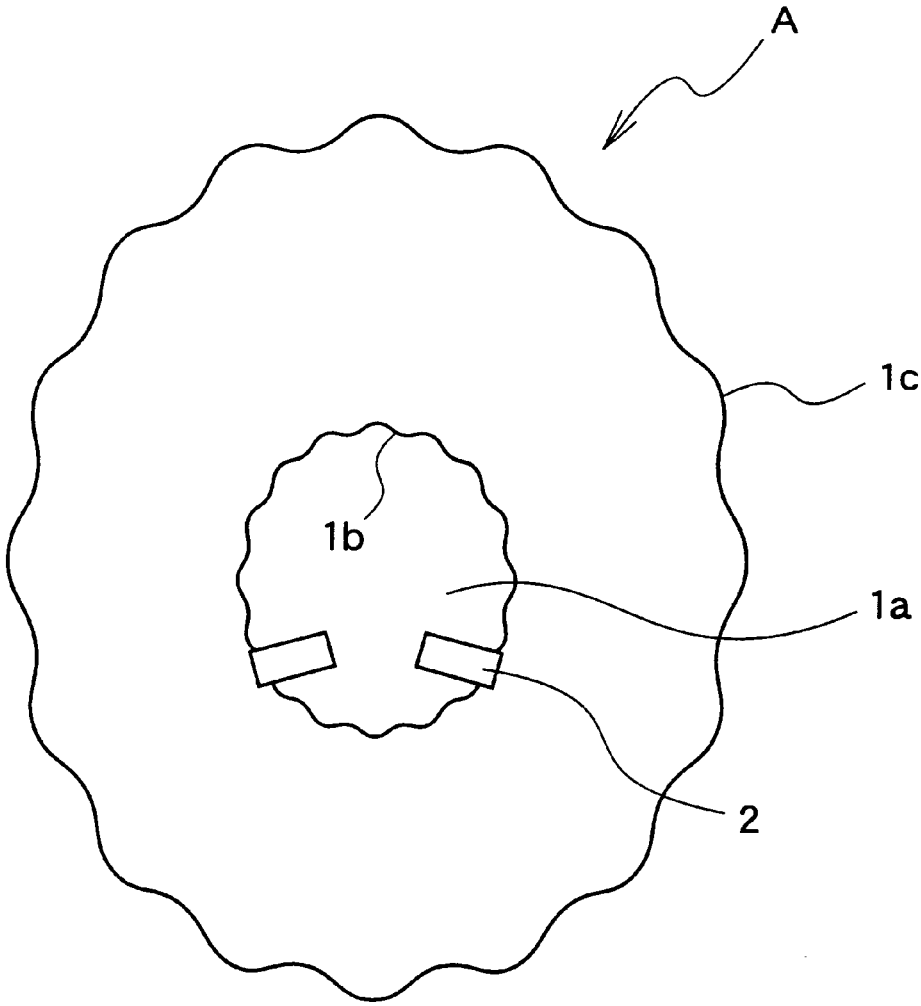
FIG. 1 is a plan view illustrating a structure of a hair washing waterproof sheet according to a first embodiment of the present invention.

FIG. 1 is a plan view illustrating a structure of a hair washing waterproof sheet according to the first embodiment of the present invention.

A hair washing waterproof sheet A comprises an approximately rectangular sheet, such as a vinyl sheet, which has an opening part 1*a* having such a size that a head part can be inserted, in the center thereof. Each of an inner circumference part 1*b* and an outer circumference part 1*c* of the waterproof sheet is made in the form of a tube and an elastically stretchable string is passed through the tube, whereby the inner and outer circumference parts are stretchable. In this case, the strings are elastic braids. Further, magic tapes 2 (coupling means) are provided at opposed positions in a lower part of the inner circumference part 1*b* of the hair washing waterproof sheet A.

Figure 2:
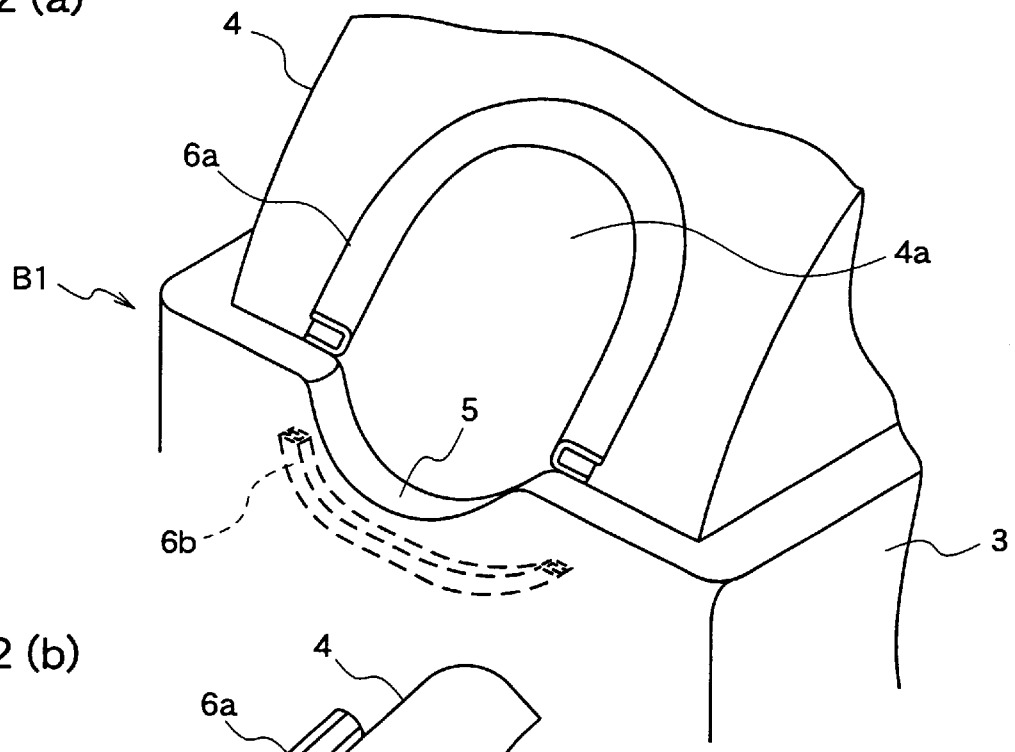
FIGS. 2(*a*), 2(*b*), and 2(*c*) are a perspective view, a side view, and a front view, respectively, which schematically illustrate a structure of a face cover of an automatic hair washer according to the first embodiment of the present invention.
Figure 2:
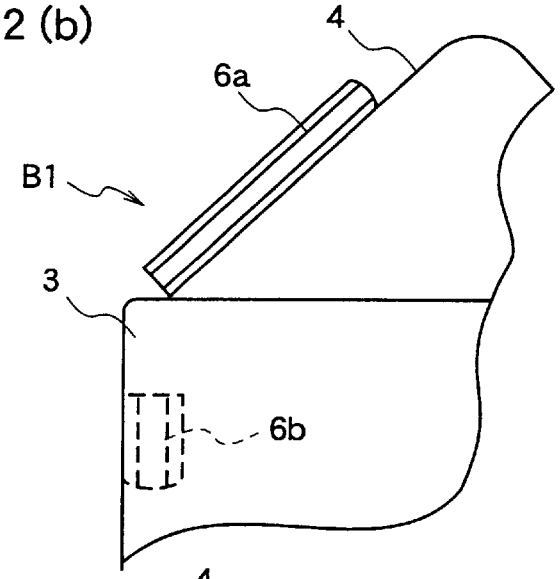
Figure 2:
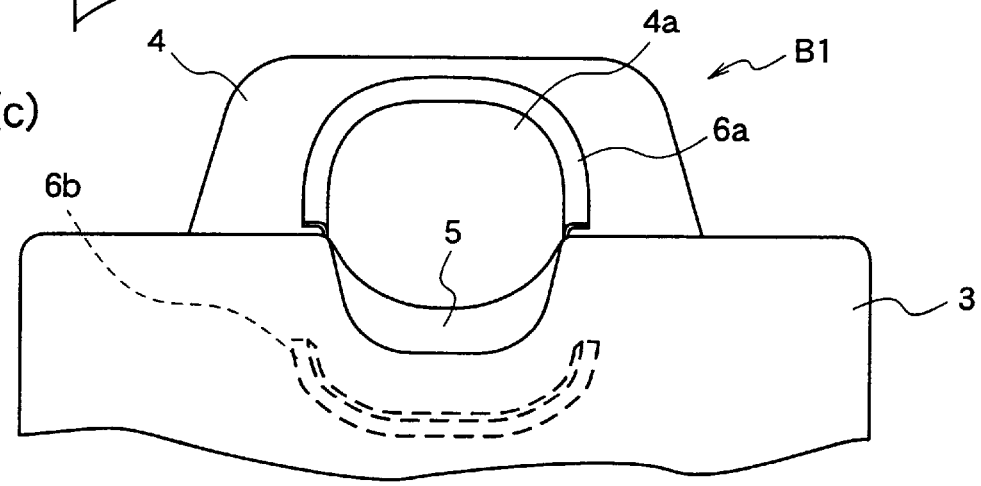

FIGS. 2(*a*), 2(*b*), and 2(*c*) are a perspective view, a side view, and a front view, respectively, which schematically illustrate a structure of a face cover part of an automatic hair washer according to the first embodiment.

In the figures, the same reference numerals as those in FIG.5 designate the same or corresponding parts. Character B1 designates an automatic hairwasher. Numeral 5 designates a neck receiving part. Numerals 6*a* and 6*b* designate hooks provided along the opening part 4*a*, and the hooks 6*a* and 6*b* are provided at an entering edge part of the face cover 4 and under the neck receiving part 5 inside the cistern 3, respectively. The hooks 6*a* and 6*b* are formed by curving U-shaped bars in the form of semi-ellipse. Here, the U-shaped bar provided at the entering edge part of the face cover 4 is covered by an acrylic cover.

Figure 3:
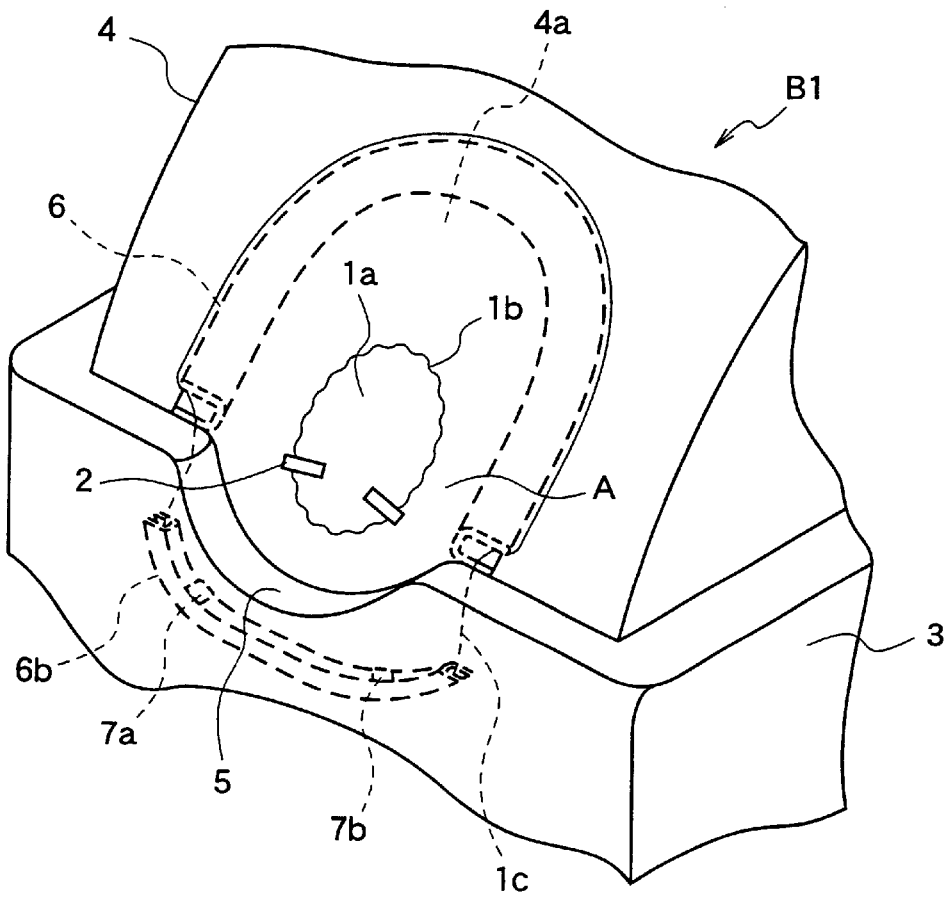
FIGS. 3(*a*) and 3(*b*) are a perspective view and a front view, respectively, which illustrate a state where the hair washing waterproof sheet of FIG. 1 is attached to the automatic hair washer of FIG. 2.
Figure 3:
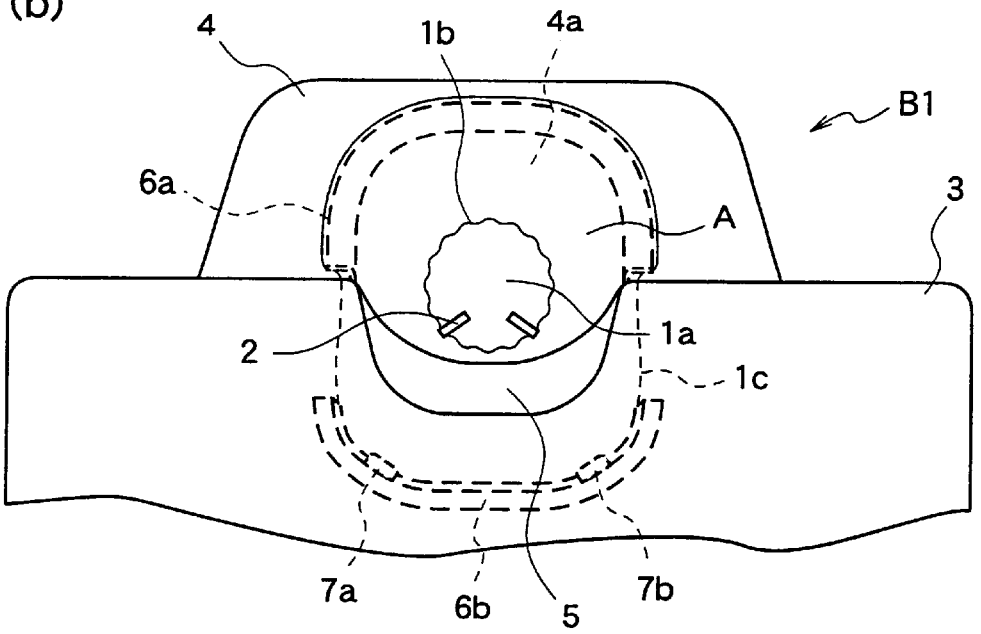

FIGS. 3(*a*) and 3(*b*) are a perspective view and a front view, respectively, which illustrate a state where thus constructed hair washing waterproof sheet A is attached to the automatic hair washer B1.

In the figures, the same reference numerals and characters as those in FIGS. 1 and 2 designate the same or corresponding parts. Numerals 7*a* and 7*b* designate fasteners for fixing the outer circumference part 1*c* of the hair washing waterproof sheet A to the hook 6*b*. The fasteners 7*a* and 7*b* prevent the hair washing waterproof sheet A attached to the face cover 4 from coming off the hooks 6*a* and 6*b*.

In the figures, an upper part of the outer circumference part 1*c* of the hair washing waterproof sheet A is fastened to the hook 6*a* of the face cover 4 and a lower part of the outer circumference part 1*c* thereof is fastened to the hook 6*b* which is provided on an inner surface of the cistern 3.

Figure 4:
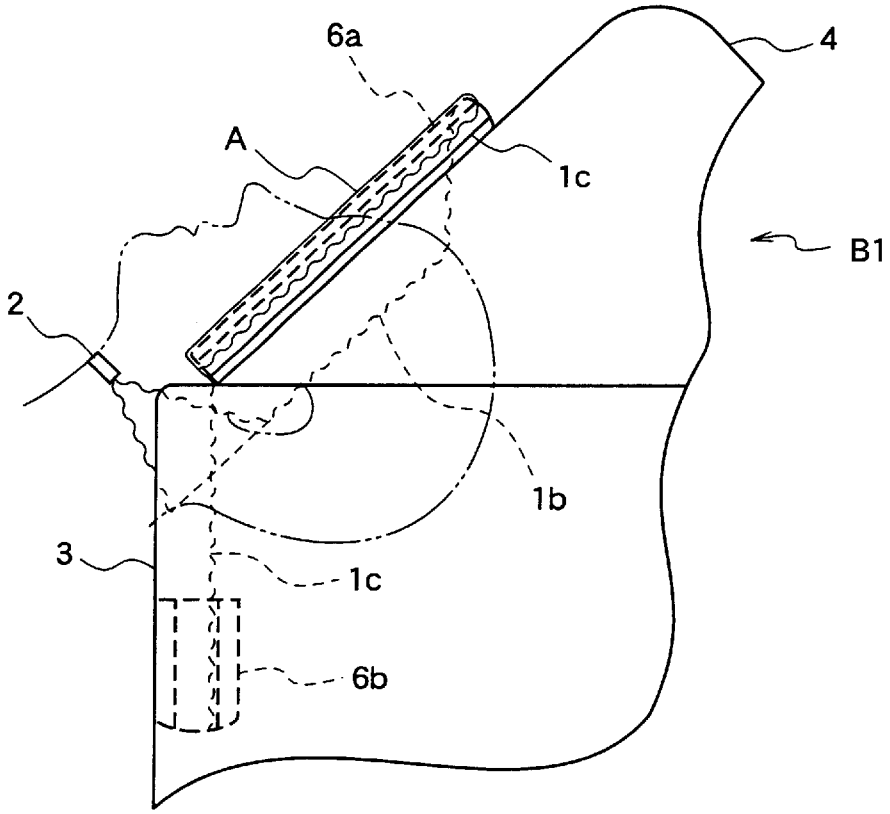
FIGS. 4(*a*) and 4(*b*) are a side view and a perspective view, respectively, which illustrate a state where the hair washing waterproof sheet is attached to a person under hair washing.
Figure 4:
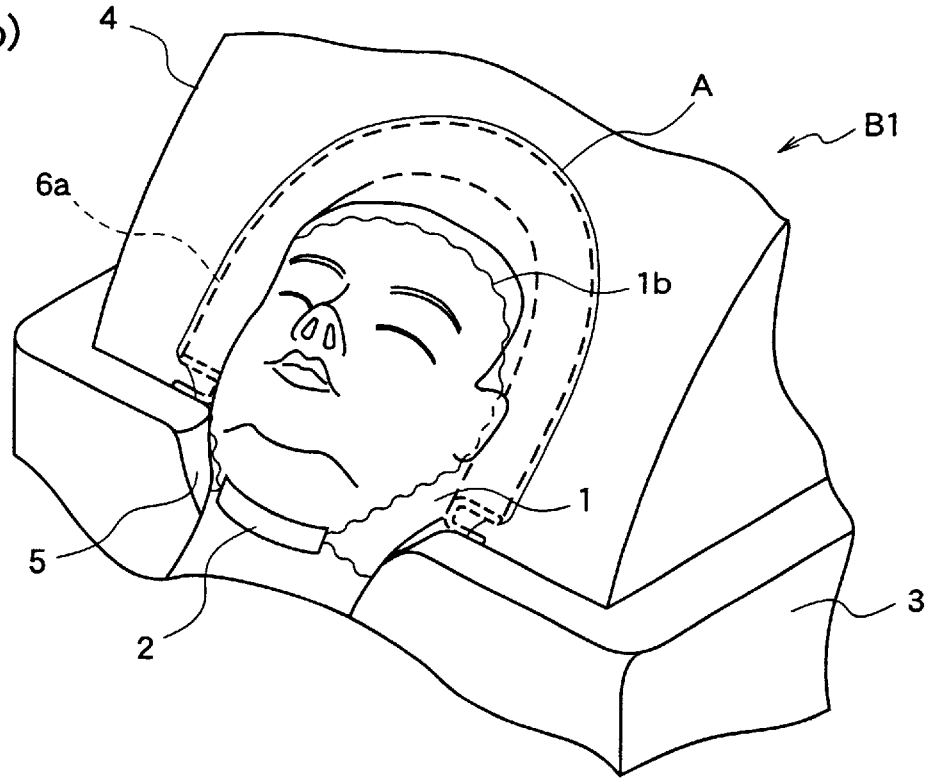

FIGS. 4(*a*) and 4(*b*) are a side view and a perspective view, respectively, which illustrate a state where the hair washing waterproof sheet A is attached to a person under hair washing.

In the figures, the inner circumference part 1*b* of the hair washing waterproof sheet A is in contact with the face of the person under hair washing. Further, the magic tapes 2 provided at slightly lower positions of the inner circumference part 1*b* are coupled with each other at a neck part of the person under hair washing, whereby the lower part of the hair washing waterproof sheet A is in contact with a rear surface of the neck of the person.

Hereinafter, a method of using the hair washing waterproof sheet A will be described with reference to FIGS. 3 and 4.

Initially, the face cover 4 is made open, and then the lower part of the outer circumference part 1*c* of the hair washing waterproof sheet A is hooked to the hook 6*b* and fixed by the fasteners 7*a* and 7*b*. Next, the person under hair washing inserts his head through the opening 1*a* of the hair washing waterproof sheet A toward the cistern 3. Then, the magic tapes 2 are coupled with each other at the neck part of the person under hair washing, whereby the lower part of the hair washing waterproof sheet A is in contact with the rear surface of the neck of the person. Thereafter, the face cover 4 is closed and the upper part of the outer circumference part 1*c* of the hair washing waterproof sheet A is fastened by the hook 6*a*. Here, the pressure applied to the face by the elastic braid of the inner circumference part 1*b* can be adjusted with the magic tapes 2.

The outer circumference part 1*c* of the stretchable hair washing waterproof sheet A is fastened by the hooks 6*a* and 6*b* and then fixed by the fasteners 7*a* and 7*b*. Therefore, even when the person under hair washing moves his head while hair is washed, the hair washing waterproof sheet A does not come off the automatic hair washer B1, whereby the wash water is not scattered from the opening 4*a*.

As described above, the hair washing waterproof sheet A according to the first embodiment comprises a vinyl sheet having the circular opening 1*a* through which the head can be inserted, in the center thereof, the inner circumference part 1*b* of the vinyl sheet is passed through by an elastic braid, and the magic tapes 2 are provided at opposed positions of the lower part of the inner circumference part 1*b*. Therefore, when the head is inserted through the opening 1*a* toward the cistern 3, the hair washing waterproof sheet A can be adjusted according to the size of the face of the person under hair washing so that a gap is not formed between the opening 4*a* of the face cover 4 and the face of the person, thereby preventing the leakage of wash water without making the person under hair washing feel something is wrong at his face.

In addition, the hair washing waterproof sheet A according to the first embodiment comprises a vinyl sheet, elastic braids, and magic tapes, thereby preventing the leakage of water more economically with relative to a face seal which is used in the prior art automatic hair washer to prevent the leakage of water.

Further, in the automatic hair washer B1 according to the first embodiment, the hooks 6*a* and 6*b* are provided along the opening 4*a* of the face cover 4, the hair washing waterproof sheet A is attached along the opening 4*a*, and the hair washing waterproof sheet A is further fixed by the fasteners 7*a* and 7*b*. Therefore, the hair washing waterproof sheet A can be attached to the face cover 4 so as not to come off the face cover while hair is washed and can be easily detached after hair washing is finished.

What is claimed is:

1. A hair washing waterproof sheet used when hair washing is performed with an automatic hair washer, which comprises a cistern capable of accommodating a head part of a person, and a face cover which is openably/closably attached to the cistern and has an opening for directing only a face outside, the hair washing waterproof sheet preventing wash water from leaking through a gap between the opening of the face cover and the head part of the person, comprising:

an approximately rectangular sheet having an opening in the center;

an outer circumference part attached to the automatic hair washer and an inner circumference part in contact with the head part of the person, the outer and inner circumference parts being made crinkled by elastically stretchable strings; and coupling means for fixing the inner circumference part to the person, the coupling means being provided at opposed positions of a lower part of the inner circumference part.

2. An automatic hair washer using the hair washing waterproof sheet of claim 1 comprising:

a hook for fastening the outer circumference part of the hair washing waterproof sheet, the hook being provided at an edge part of the opening of the face cover.

* * * * *